US006393877B1

(12) United States Patent
Church

(10) Patent No.: US 6,393,877 B1
(45) Date of Patent: May 28, 2002

(54) SECURITY SUPPORT SYSTEM TO DISPLAY ITEMS

(76) Inventor: Joseph O. Church, 3262 S. Delaware St., Englewood, CO (US) 80110

( * ) Notice: Subject to any disclaimer, the term of this patent is extended or adjusted under 35 U.S.C. 154(b) by 0 days.

(21) Appl. No.: 09/602,299

(22) Filed: Jun. 23, 2000

(51) Int. Cl.[7] ..... A47F 5/00

(52) U.S. Cl. ..... 70/62; 70/57; 70/58; 70/61; 211/7; 211/59.1; 248/551; 248/553

(58) Field of Search ..... 70/57, 58, 62, 70/61; 211/7, 59.1, 94; 248/551, 553, 225.11, 225.21, 222.14, 221.11, 229.13–229.15

(56) References Cited

U.S. PATENT DOCUMENTS 4,009,853 A * 3/1977 Lile ..... 248/201
5,676,258 A 10/1997 Leyden et al. ..... 211/7
5,765,801 A * 6/1998 Griselman ..... 248/552
6,003,685 A * 12/1999 Malin ..... 211/7

* cited by examiner

*Primary Examiner*—William A. Cuchlinski, Jr.
*Assistant Examiner*—Marthe Y. Marc-Coleman
(74) *Attorney, Agent, or Firm*—Timothy J. Martin; Michael R. Henson; Mark H. Weygandt

(57) ABSTRACT

A security support system and method adapted to display an item on a support surface having spaced apart parallel channels to lockably retain the item against unauthorized removal. The security support system includes a base member that is sized and configured to engage the channels, a support arm that is adjacent to the base member that holds the display item, an optional retainer element that is sized to prevent removal of the display item and a lockable element that engages the support arm on the distal end opposite the base member. The lockable element is secured to the support arm in a locked state and is configured alone or with the optional retainer element to prevent removal of the display item. The lockable element in an unlocked state disengages from the support arm allowing removal of the display item and the optional retainer.

23 Claims, 5 Drawing Sheets

SECURITY SUPPORT SYSTEM TO DISPLAY ITEMS

FIELD OF INVENTION

The present invention generally relates to devices that accommodate the display of commercial items for sale and more particularly to devices for the display of commercial items for sale that must be protected from unauthorized removal. The invention addresses this situation by having a security support system and a method of using the security support system to mount the displayed items on a slot support surface, to support the display items for sale, and to lockably retain the items from unauthorized removal.

BACKGROUND OF THE INVENTION

It is of necessity that a retailer must efficiently use the available space available in a particular store and to minimize the staff requirements to keep overhead low, thus allowing the retailer to effectively compete price wise, being able operate on a smaller markup margin. To this end the efficient use of retail space requires displaying items on all available space, such as walls, aisle stands, ceilings, counter tops, and shelving. The need for versatile display surfaces creates the requirement for an adjustable system for displaying items not only on various surfaces, but also different sizes and types of items as well. What has been employed in the past has been pegboard that has the advantages of flexibility for displaying many different types of items, however, pegboard has limitations for heavier and bulkier items, is difficult to secure display items from unauthorized removal, and typically does not give the most pleasing aesthetic appearance. Another device employed has been counter tops and shelving of various types, shelving is limited in the size and weight of an item that be displayed, and it is difficult to prevent the theft of display items from a shelf without enclosing the shelf in a lockable glass door. The lockable glass door has the disadvantage of not allowing the customer to touch and feel the item, requires a staff member to unlock the door, and the glass door does not provide a high level of security against theft. When a customer handles a display item loose in their hands there is always some risk that the item may be dropped causing damage to the item, or injury to the customer from dropping the item on their person. Counter tops have similar shortcomings to pegboard with the added disadvantage of less effective use of available space for the display of items in the retail store.

A slot support surface overcomes some of a pegboard's limitations as it has the ability to support bulkier and heavier items and gives a more pleasing and professional appearance that has importance, as it is part of the display for the items being sold. One limitation that the typical slot support surface has, though, is in the inability to prevent unauthorized removal of the display items supported on the slot surface. This limitation has become even more important in recent times as a part of the previously mentioned goal of a retailer is to minimize staff overhead to remain competitive. This results in more unattended items that are on display through out the store and with the desire by the retailer to be able to display higher value items without staff attendance creates the need for a way to lockably retain the display items on the slot support surface.

The benefits to the retailer of a security support for the display of items on a slot support surface are numerous; such as versatility in using limited retail display space to display a wide variety of items, being able to display high value items without fear of theft of the display items, and letting the customers to see, touch, and feel the items without the need for staff to be present. In addition to eliminate the attendant risk of a customer damaging the display item by dropping it, or the customer injuring themselves by dropping the display item on their person.

As there is ever increasing competitive pressure in the business of retailing, the need for a display item to "sell itself" without the need for staff support is ever more important, while minimizing the risk of loosing the display item due to theft. Both of these benefits add up to a reduction in costs that is beneficial to the retailer.

SUMMARY OF THE INVENTION

It is an object of the present invention to provide a new and useful security support system that is adapted to display an item on a support surface and to lockably retain the item against unauthorized removal.

It is another object of the present invention is to provide a security support system wherein the base member is adapted to attach to a slot support surface in a manner such that the base member cannot be directly disengaged from the slot support surface.

It is a further object of the present invention to provide a security support system wherein a retailer can display high value items openly to customers and wherein the high value items would be protected from unauthorized removal without the attendant need for a retailer staff person to be present.

Still a further object of the present invention is to reduce the need for retailer staffing to show and watch over high value items allowing the retailer to be more competitive.

Still another object of the present invention is to provide a security support system for display items that has the versatility to accommodate a wide variety of display item sizes and weights and to lockably retain these items from unauthorized removal.

Yet another object of the present invention is to allow the retail customer to handle the display item, further enhancing the concept of the item selling itself while eliminating the risk of damage to the item from it being dropped, injury to the customer from dropping the item on their person, and preventing theft of the item.

Still yet another object of the present invention is to provide a security support system that can be mounted on a support surface that can be a wall, a ceiling, a table or counter top, a shelf, or the floor.

According to the present invention, then, a security support system is provided that is adapted to display an item on a support surface and to lockably retain the item against unauthorized removal. Broadly, the present invention includes a base member that is adapted to be secured to a support surface. A support arm extends from and is supported by the base member so as to have a proximal end portion adjacent to the base member and a distal end portion opposite the proximal end portion. A lockable element is adapted to engage the distal end portion of the support arm. The lockable element is secured to the support arm in a locked state and is removable from the support arm in an unlocked state. The lockable element provides retention of the display item on the support arm to prevent unauthorized removal of the display item. A retainer element may be used to increase the ability of the lockable element to secure the item against removal.

The security support system of this invention is adaptable for a wide variety of support surface types such as walls, ceilings, shelving, counter and tabletops, and floors. In addition the security support system is designed to accommodate a number of display items that vary in size and weight while retaining the feature of preventing unauthorized removal of the display items.

In one embodiment of the present invention, the base member includes a central portion and has opposite outer first and second edge margins, with a first flange disposed on the first edge margin and a second flange disposed on the second edge margin. The first and second flanges that project oppositely of each other are sized and configured to be received into the spaced apart channels that are in the slot support surface. When the base member is received into the spaced-apart channels, it is secured to the slot support surface such that the base member cannot be directly disengaged from the slot support surface. To facilitate the first edge margin and first flange portion of the base member and the second edge margin and second flange portion of the base member to be received into the spaced apart channels of the slot support surface the base member is constructed of a first and a second section respectively. The first and second sections are adapted to be attached together by tamper resistant fasteners such that the first and second sections cannot be easily disengaged.

The support arm has a proximal end portion and a distal end portion such that the proximal end portion is adjacent to the base member either permanently or non-permanently in a manner that prevents direct disassembly of the support arm proximal portion from the base member. A lockable element is included that is adapted to engage the distal end portion of the support arm and be secured to the support arm in a locked state and removable from the support arm in an unlocked state.

It is anticipated that the security support be used in a retail store environment for the display of items for sale. The base member of the security support would be received into a slot wall support surface so that the base member cannot be directly disengaged from the slot wall support surface. The display items are then fitted onto the support arm wherein the support arm is adapted to accommodate a variety of different sizes and weights of the display items. A lockable element is then engaged on the distal end portion of the support arm and placed into a locked state to prevent unauthorized removal of the display item. This allows a customer to handle the display item without the risk of dropping and possibly damaging the item, or the customer getting hurt from dropping the item on themselves, or the item getting stolen.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

Figure 1:
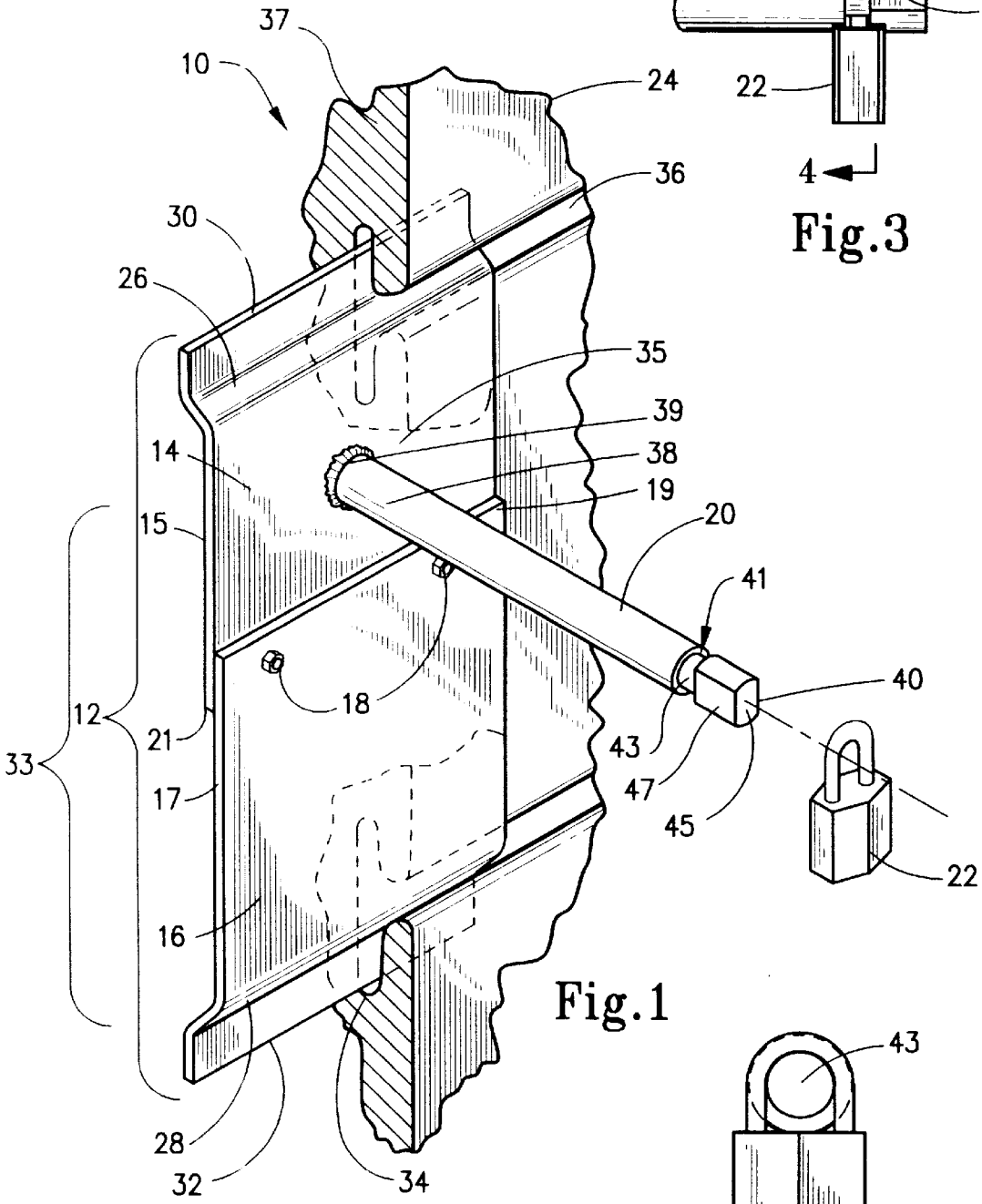
FIG. 1 is a perspective view of a first embodiment of the security support according to the present invention showing the first and second flange ends received into the slot support surface.

The present invention relates to devices that accommodate the display of commercial items that are for sale and more particularly to devices for the display of commercial items for sale that need to be protected from unauthorized removal. With the ever increasing pressure on retailers to be more competitive, there needs to be new technology that enables a retailer to sell items more efficiency either through better methods of getting items to customers who desire them or a way to offer items to customers as they currently are offered with lower costs or both a better method and lower costs.

The present invention addresses both of these retailer desires by providing a method to display items for sale and by lower costs to the retailer through reduction in sales staff requirements especially for the display of high value items. Thus while the description of the exemplary embodiments are made using the security support on a slot support wall surface, it should be understood that other equivalent embodiments are contemplated within the scope of the invention. Thus for example the security support could be suspended from a ceiling, mounted on a floor, on a shelf, or on a counter top, in addition a plurality of security supports in a variety of sizes can be employed to accommodate almost any shape of item to be displayed and secured from unauthorized removal.

The security support system is adapted to lockably retain a displayed item relative to a support surface to protect against unauthorized removal of the displayed item. The method of protecting displayed items from unauthorized removal by using a lockable retention using the security support, starts with a first step of mounting the base to the slot support surface such that unauthorized personnel cannot demount the base from the slot support surface. This first step can be accomplished a number of ways, either by sliding the base into the slot support surface channel ends that are open and then capping off the channel ends to prevent unauthorized removal of the base from the slot support surface. Alternatively, the first step can be completed by separating the base into a first base section and second base section. These two sections can then be positioned to insert the base flange ends into the slot support surface channels at a place other than the ends of the slot support surface channels. Next, the base sections are reconnected with tamper resistant fasteners to form a tamper proof base assembly that cannot easily be disassembled and removed from the slot support surface by an unauthorized person.

The second method step in using the security support system is to fit the display item onto the support arm that extends from the base. Where differently shaped and sized display items are to be displayed, a plurality of support arms can be used to support and secure the displayed items. Also the plurality of support arms can either be secured to a common base or each support arm can be secured to its own respective individual base depending upon the overall shape and size of the displayed items and the slot support surface configuration.

The third method step in using the security support is to secure the displayed items to the security support by engaging the support arm on the distal end portion opposite of the base with a lockable element. When in a locked state, the lockable element prevents unauthorized removal of the displayed item and when in an unlocked state, the displayed item can be removed from the security support. As an enhancement of the third method step, a retainer element can be added that fits in between the displayed item and the lockable element. This retainer can engage a single support arm, or, alternatively, the retainer element may be constructed so that it engages a plurality of support arms. The purpose of the retainer element is that it is sized and configured to prevent unauthorized removal of the displayed item in the case where the lockable element cannot be easily sized and configured to prevent removal of the displayed item even while in a locked state. As an alternative, a plurality of retainer elements that are sized and configured to prevent removal of the displayed items can be engaged onto a plurality of support arms after fitting the displayed items and before securing the displayed items with one or more lockable elements.

The sequence of method steps must follow a set order of completion of the first step of mounting the base into the slot support surface to prevent removal by an unauthorized personnel, a second step of fitting the displayed item onto the support arm, an alternate intermediate step between steps two and three of adding a retainer element to engage the support arm, or a retainer element to engage a plurality of support arms, or plurality of retainer elements to engage a plurality of support arms, and finally a third step of securing the displayed items by engaging the support arm with a lockable element or alternatively engaging a plurality of bean extensions with a plurality of lockable elements.

The first exemplary embodiment of the present invention is accordingly shown in FIGS. 1–11 wherein the security support assembly 10 is mounted on the slot support surface 24. Slot support surface 24 has a plurality of parallel, spaced-apart channels 34 that are T-shaped in cross-section. The security support assembly 10 includes a base member 12 and a support arm 20. In this particular embodiment, base member 12 is constructed in two sections, a first section 14 and a second 16, that extend oppositely of each other when interconnected. This allows each of sections 14 and 16 to be inserted into the slot support surface independently of one another. This eliminates the necessity of sliding the base member 12 from the slot support wall ends 37 in channels 34 along the slot support surface 24.

First section 14 includes a flat plate portion 15. Likewise, section 16 includes a flat plate portion 17. Inner edge margins 19 and 21 of plate portions 17, 15 overlap and are fastened together with tamper proof fasteners 18. When assembled, base member 12 has an edge margin 26 and flange 30 that forms an offset end for first section 14. Likewise, base member 12 has an edge margin 28 and flange 32 that forms an offset end for second section 16. Here, each respective section edge margin and flange is sized and configured to be independently received into the channels 36.

After the respective first section member 14 and second section 16 of base member 12 are inserted into the slot support surface 24, tamper resistant fasteners 18 are employed to interconnect plate portions 15 and 17 so that they are generally in a common plane thus defining a central section 33. This secures the base member 12 in slots 34 along the slot support surface 24 with flanges 26 and 28 engaging a pair of channels 34 so that the base member 12 cannot be directly disengaged from slot support surface 24. Attachment techniques other than fasteners 18, as know in the art, can be used to fasten the first section base member 14 and second section base member 16 in permanently together. Examples would include filet welding, spot welding, riveting, bolting, etc., that prevents unauthorized disassembly of the first section 14 and second section 16.

As is depicted in FIGS. 1–11, support arm 20 has a proximal end portion 38 adjacent to the base member 12 and a distal end portion 40 opposite proximal end portion 38. The support arm 20 is supported by the base member 12, and specifically section 14, although support arm 20 could as easily be secured to section 16. In the Figures, the proximal end portion 38 of the support arm 20 is permanently affixed to the central portion 33 of the base member 12 by fillet welding at weldment 39. Other permanent means for attachment of the support arm 20 to the base member 12 are acceptable, such as forming base member 12 and the support arm 20 unitarily out of homogenous material, staking support arm 20 and base member 12 with or without threads, high interference shrink or press fitting support arm 20 and base member 12, riveting, or any equivalent method that prevents direct disengagement of the support arm 20 from the base member 12. Non permanent fasteners are also acceptable to make the support arm 20 adjacent to the base member 12 such as tamper proof fasteners, bolts, a washer attached to the support arm 20 that is between the base member 12 and the slot support surface 24, or any equivalent means that prevents direct disengagement of the support arm 20 from the base member 12.

Figure 2:
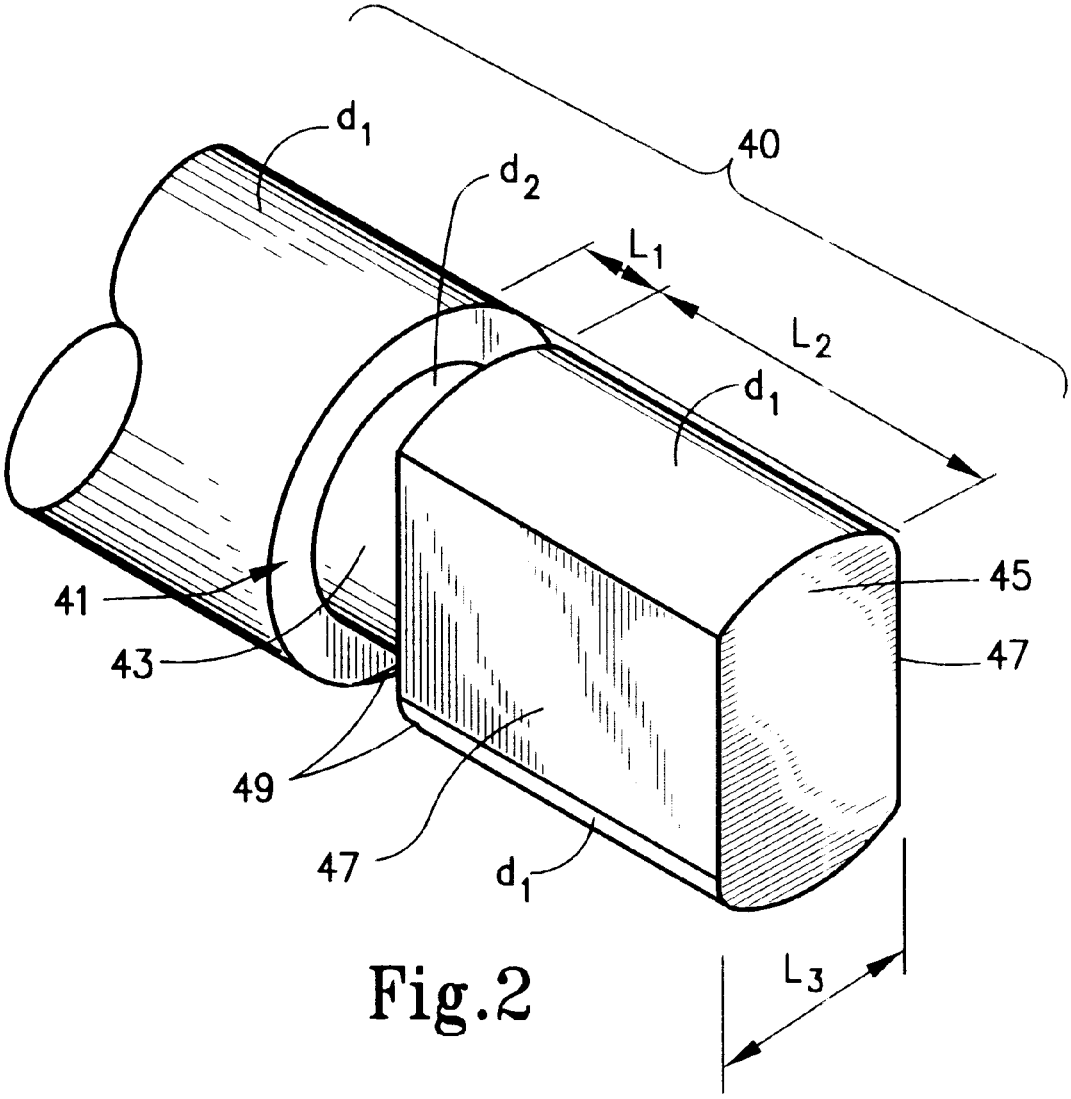
FIG. 2 is a perspective view of the distal end portion of the support arm of FIG. 1.

As detailed in FIG. 2 a perspective view of the distal end portion of the support arm is shown for the proportional detail between diameters, lengths, and surfaces that act to attach the lockable element. The distal end portion 40 of the support arm 20 dimensionally consists of an outside diameter $d_1$, a circumferential groove 41, and neck 43 defined by $d_2$ and $L_1$, and a head 45 with sides 47. The dimensional relationship between $d_1$ and $d_2$ is such that, $d_2$ is less than $d_1$ with $d_2$ being equal to or less than the inside diameter of the hasp 44 belonging to the lockable element 22. The length of the neck 43 is defined by $L_1$, with $L_1$ being equal to or greater than the hasp 44 shank diameter of the lockable element 22. The length $L_2$ of the head 45 must be at least the same dimension as the hasp 44 shank diameter. The sides 47 of the head 45 are sized such that dimension $L_3$ is equal to or less than the inside diameter of the hasp 44. If required for the lockable element 22 to engage in a locked state on the distal end portion 40 of the support arm 20, a clearance relief 49 may be required in the distal end portion 40 as shown.

Figure 3:
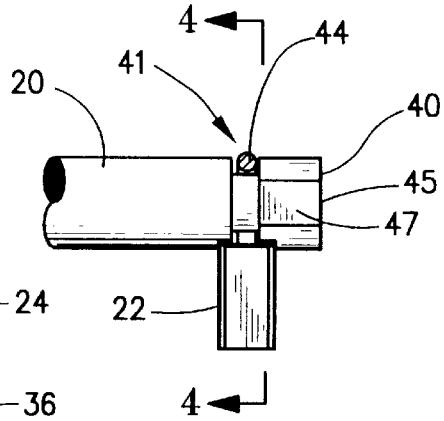
FIG. 3 is a side view in elevation showing the distal end portion of the support arm of FIG. 2 with a lockable element in a locked state.
Figure 4:
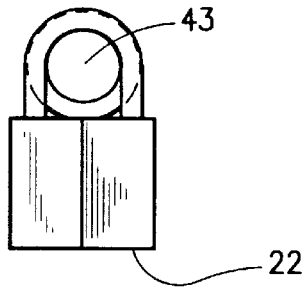
FIG. 4 is a cross-sectional view taken about lines 4—4 of FIG. 3.
Figure 5:
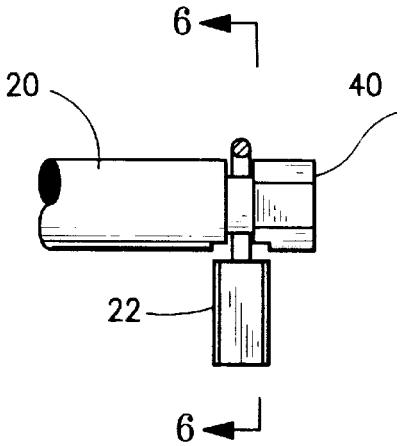
FIG. 5 is a side view in elevation of the distal end portion of the support arm of the security support system of FIG. 1 showing the lockable element in an unlocked state so that it is removable from the distal end portion of the support arm.
Figure 6:
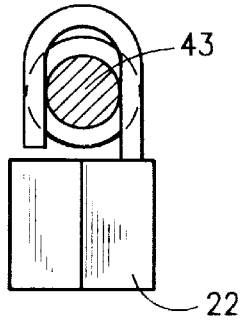
FIG. 6 is a cross sectional view taken about lines 6—6 of FIG. 5.

The distal end portion 40 of support arm 20 is adapted to be engaged by a lockable element 22. To this end, a circumferential groove 41 is formed on distal end portion 38 to define a neck 43 and a head 45. Head 45 is flattened on two sides 47. As is shown in FIGS. 2 and 3, lockable element 22 is in a locked state wherein the lockable element 22 is secured to the distal portion 40 of the support arm 20. Here, lockable element 22 has a hasp 44 that is configured to surround neck 43 but has a dimension smaller than head 45 when locked. As is shown in FIGS. 5 and 6, the lockable element 22 is in an unlocked state 42 being removable from the distal end portion 40 of the support arm 20 by sliding the hasp 44 of the lockable element off of the head 45 of distal end portion 40 of the support arm 20.

Figure 7:
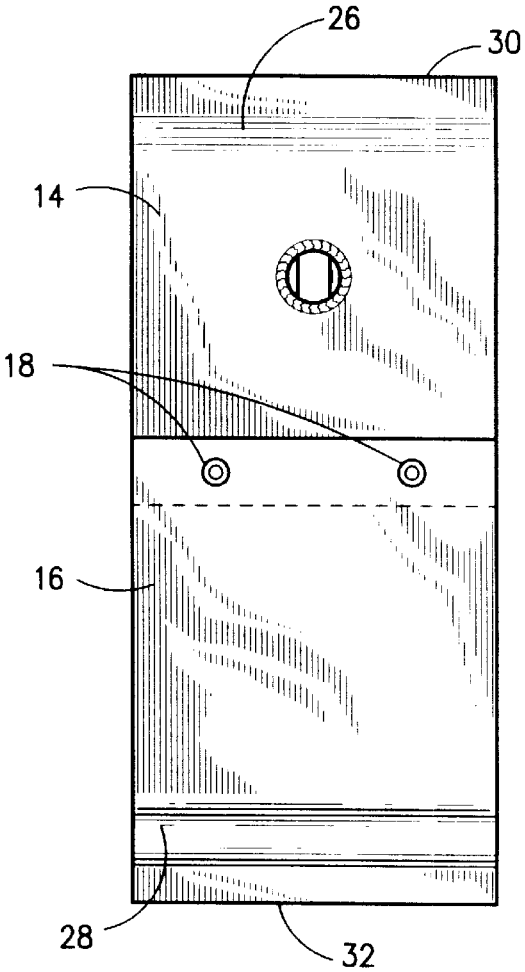
FIG. 7 is an end view in elevation of the security support system of FIG. 1.

FIG. 7 is an end view of the security support only without the slot support surface and lockable element shown. Both the first section base member 14 with its respective first edge margin 26 and first flange 30 and the second section base member 16 with its respective second edge margin 28 and second flange 32 are shown. Tamper proof fasteners 18 are shown that attach the first section base member 14 and second section base member 16.

Figure 8:
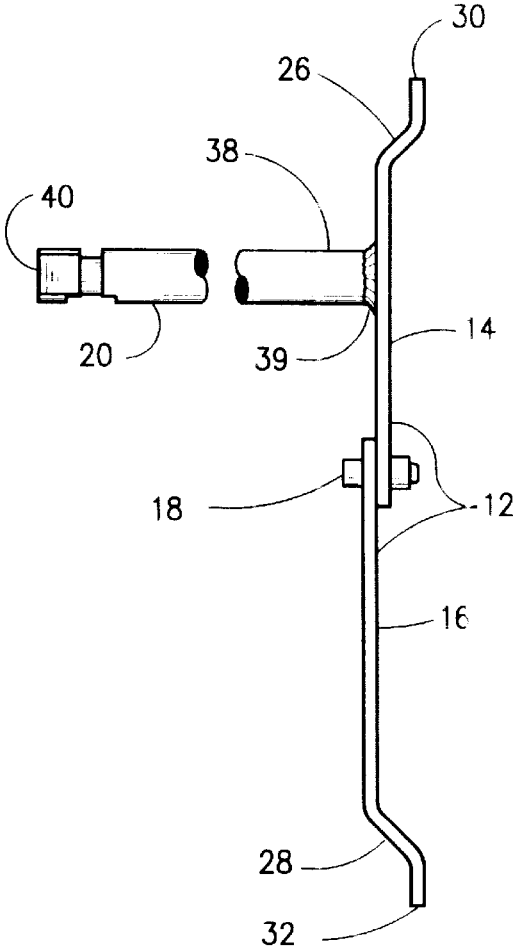
FIG. 8 is a side view in elevation of the security support system of FIG. 1.
Figure 9:
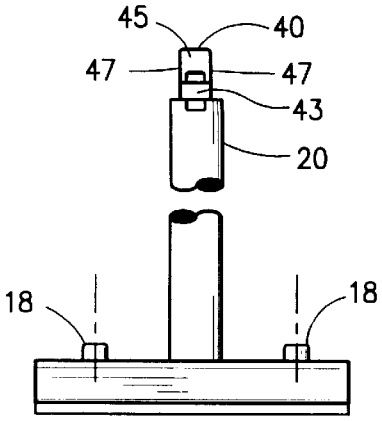
FIG. 9 is a bottom plan view of the security support system of FIG. 1.

Proceeding to FIGS. 8 and 9, the support arm 20, the distal end portion 40, and the proximal end portion 38 with the attachment of the proximal end portion 38 to the base member 12 by use of a fillet weldment 39. Both the first section base member 14 with its respective first edge margin 26 and first flange 30 that forms an offset end and the second section base member 16 with its respective second edge margin 28 and second flange 32 that forms an offset end are shown. Tamper proof fasteners 18 are shown that attach the first section base member 14 and second section base member 16.

Figure 10:
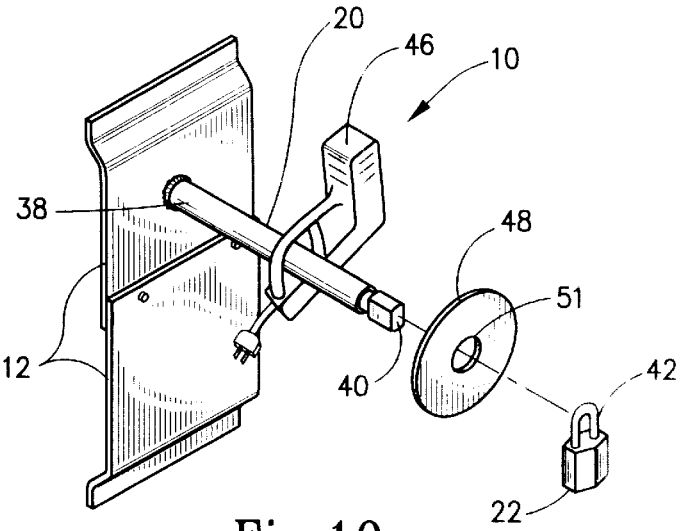
FIG. 10 is a perspective view showing the security support system of the present invention with a display item engaging and supported by the support arm, a retainer element, and the lockable element in an unlocked state ready for assembly.
Figure 11:
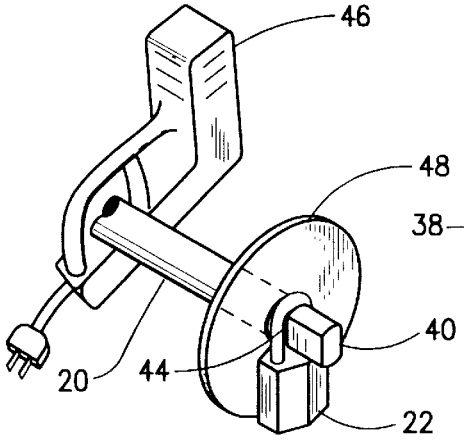
FIG. 11 is a perspective view showing the retainer element of FIG. 10 engaged on the distal end portion of the support arm and the lockable element engaged and secured in a locked state to the distal end portion of the support arm.

FIGS. 10 and 11 show the security support 10 with the displayed item 46 engaging the support arm 20. Here, a retainer element 48 is employed to engage the support arm 20 so as to define an enlarged blocking structure for items that are to be secured. Retainer element 48 is formed as an annular washer having a central opening 51 that is sized for close-fitted mating engagement on support, arm 20. The lockable element 22 in an unlocked state 42 is ready to be assembled onto the distal end portion 40 of the support arm 20.

FIG. 11 shows the retainer element 48 that is sized and configured to prevent removal of the displayed item when the retainer element 48 engages the support arm 20, and the lockable element 22 that is in a locked state.

Figure 12:
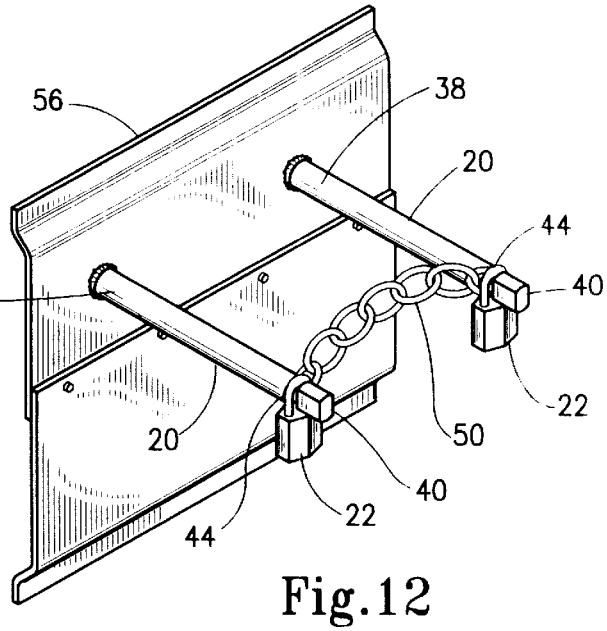
FIG. 12 is a perspective view showing a security support system according to a first alternative embodiment of the present invention wherein two support arms are attached to a common base member with a common locking chain retainer extending between the two support arms and secured by two lockable elements each in a locked state.
Figure 13:
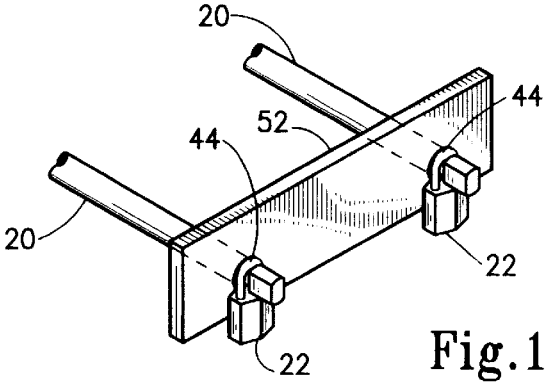
FIG. 13 is a perspective view showing the security support the distal end portions of the support arms of the security support system of FIG. 12 but with a second alternative locking bar retainer secured by a pair of lockable elements in a locked state, each engaged and secured to the distal end portion of each support arm.
Figure 14:
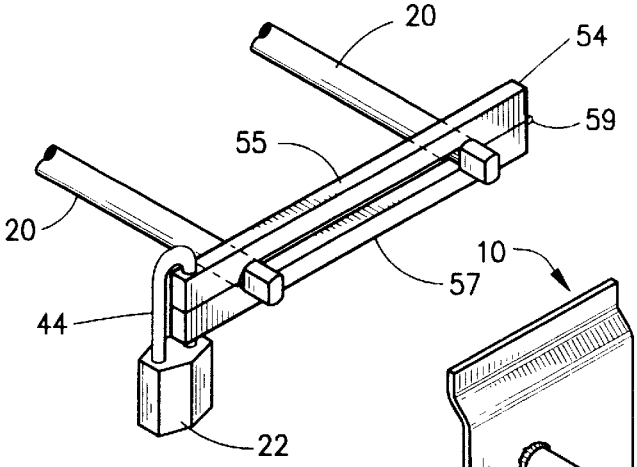
FIG. 14 is a perspective view showing the distal end portions of the support arms of the security support system of FIG. 12 but with an alternative locking clamp bar retainer secured by a single lockable element in a locked state engaged and secured to the end of the locking clamp bar.

FIGS. 12, 13 and 14 show the security support system of the present invention utilizing a plurality of support arms 20 that are designed to accommodate a wide variety of displayed item shapes and sizes to secure and support. The plurality of support arms 20 each include a proximal end portion 38 that is adjacent to a singular base support 56 and a distal end portion 40 opposite the proximal end portion 38. The support arms 20 are each configured as described above with respect to FIGS. 1–11. A plurality of lockable elements 22 that are adapted to engage each distal end portion 40 of the support arms 20 in a locked state 44 can be used alone to secure the displayed item and are removable from the distal end portion 40 of the support arm 20 in an unlocked state 42. Individual support arm 20 retainer elements such as 48 in FIG. 10 can be used in conjunction with the lockable elements 22 on each support arm 20. Alternatively, as is shown in FIG. 12, a chain retainer element 50 can be added that interconnects the distal end portions 40 of a pair of support arms 20 and secures the displayed item by use of a plurality of lockable elements 22 that are adapted to engage the distal end portions 40 of the support arm 20 and the chain retainer element 50 while in a locked state 44.

Bar retainer element 52, as is shown in FIG. 13 can be provided to engage a pair of support arms 20 and is sized and configured to prevent removal of the displayed item when the bar retainer element 52 engages the support arms 20. Bar retainer element 52 is secured by the lockable elements 22 that engage each support arm 20 in a locked state 44.

Yet another alternative retainer is shown in FIG. 14. Here, a clamping bar retainer element 54 is adapted to engage a pair of support arms 20. Clamping bar retainer element 54 has a pair of jaws 55 and 57 that are hinged at 59. Jaws 55 and 57 are sized and configured to prevent removal of the displayed item when the clamping bar retainer 54 engages the support arms 20 and is secured by a lockable element 22 that engages the clamping bar element 54 in a locked state.

Figure 15:
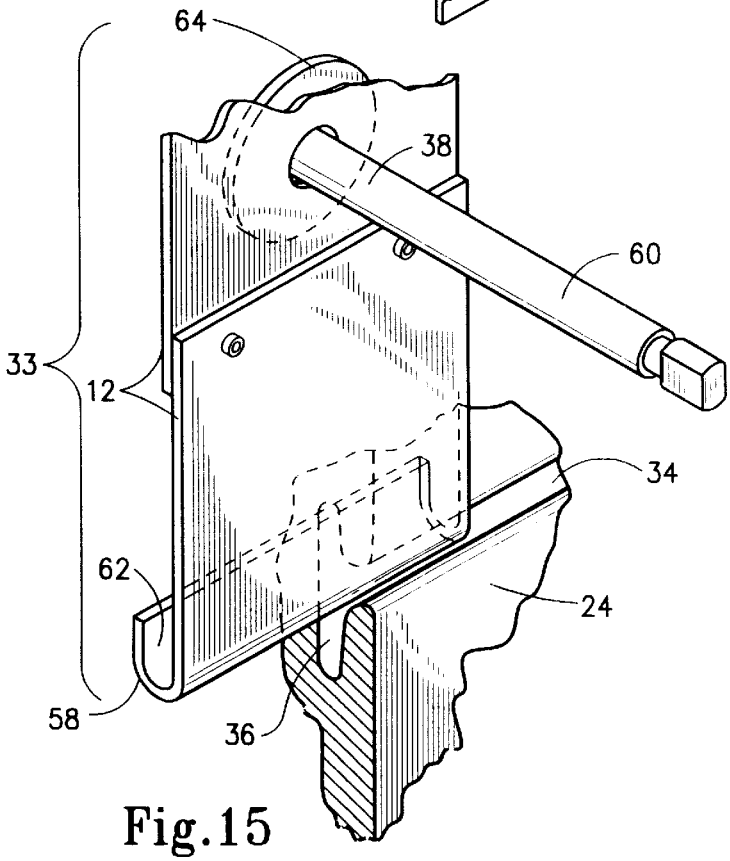
FIG. 15 is a perspective view of the security support showing one alternative of the flange end of the base configured as a "C" shaped channel that is received into the slot support surface spaced apart channel "T"-slot cross section and with the support arm in a non-permanent configuration.

Proceeding to FIG. 15 another embodiment of the base member 12 is shown with at least one of the flanges, such as the illustrated flange 58, is formed as a reverse curve defining a C-shaped cross section that is sized and configured to be received into the slot support surface 24 channel 34 T-slot 36. Note that the open portion of the C shaped cross section 62 faces the center section 33 on a side thereof opposite support arm 60.

Support arm 60 is shown in FIG. 15 with a non-permanent means for attachment. Here, a disc 64 is attached to the proximal end portion 38 of the support arm 60 such that the support arm 60 cannot be directly disengaged from the base member 12 when the base member is secured to the slot support surface 24. Naturally, other methods of securing support arm 60 could provide a non permanent means for attachment of the support arm 60 to the base member 12 such that it cannot be directly disengaged from the base member when base member 12 is secured to the slot support surface 24 are acceptable such as bolting, a locking slot arrangement, or anything that would be apparent to the skilled artisan.

Figure 16:
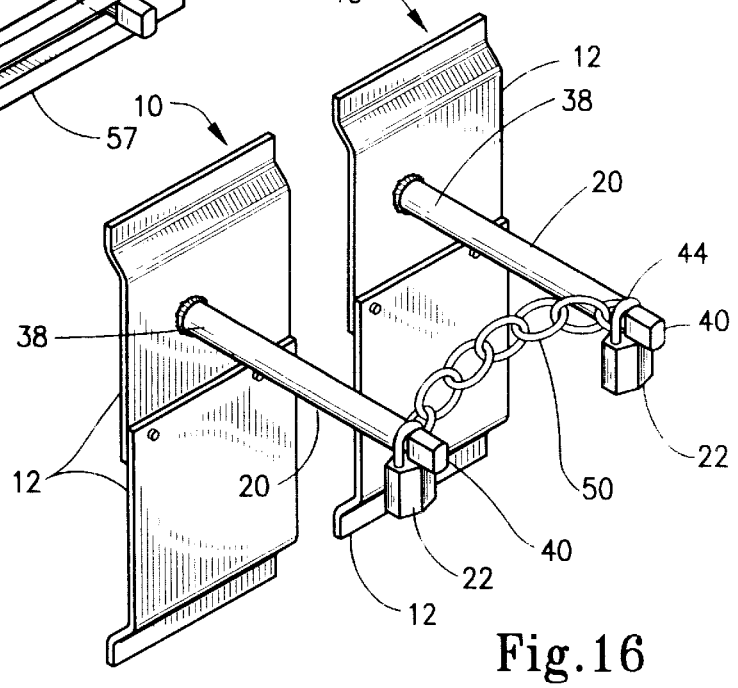
FIG. 16 is a perspective view similar to FIG. 12 but showing two support arms that are each attached to their respective individual bases with a common locking chain retainer between the two support arms.

FIG. 16 shows a pair of support assemblies 10 oriented alongside one another. Thus, a plurality of arms 20 each with a distal end portion 40 and an opposite proximal end portion 38 located at its respective individual base member 12. The plurality of base members 12 provide a pair of support arms 20 operative to hold an item for display. A plurality of lockable elements 22 then are adapted to engage each distal end portion 40 of the support arms 20 in a locked state 44 can be used alone to secure the displayed item and are removable from the distal end portion 40 of the support arm 20 in an unlocked state 42.

Alternatively, a chain retainer element 50 that is adapted to engage the distal end portions 40 of the support arms 20 can be used with the lockable elements 22 in a locked state 44 wherein the displayed item is secured from unauthorized removal. Other retainer element configurations are also acceptable such as those shown in FIGS. 11, 12, 13 and 14 that use a single retainer element 48 on each of the support arms 20, or a retainer element that is adapted to engage a plurality of support arms such as the chain retainer element 50, or the bar retainer element 52, and the clamping bar retainer element 54.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A security support system adapted to lockably retain a displayed item relative to a support surface thereby to protect against unauthorized removal of the displayed item therefrom, comprising:

(a) a base member adapted to be secured to the support surface;

(b) a support arm extending from and supported by said base member and including a proximal end portion adjacent to said base member and a distal end portion opposite the proximal end portion;

(c) a lockable element adapted to engage the distal end portion of said support arm and be secured thereto when in a locked state and removable from the distal end portion when in an unlocked state, whereby a displayed item placed on said support arm is protected against unauthorized removal therefrom when said lockable element is in the locked state; and (d) a retainer element separate from said lockable element and adapted to engage said support arm, said retainer element being sized and configured to prevent removal of the displayed item when said retainer element engages said support arm and is secured by said lockable element.

2. A security support system according to claim 1 wherein said support arm is affixed to said base member.

3. A security support system according to claim 1 wherein said support arm is detachable from said base member.

4. A security support system according to claim 1 wherein said distal end portion of said support arm has a circumferential groove and neck forming an annulus to secure said lockable element in the locked state and a head portion with sides to allow said lockable element to be removed in the unlocked state.

5. A security support system adapted to display an item and operative to lockably retain said item against unauthorized removal therefrom, comprising:

(a) a support surface having spaced apart parallel channels formed on a display surface thereof;

(b) a base member including a central portion having opposite outer first and second edge margins, a first flange disposed on the first edge margin and a second flange disposed on the second edge margin, said first and second flanges projecting oppositely one another and sized and configured to be received in the spaced-apart channels so that said base is secured to the slot surface support and so that said base member cannot be disengaged from the display surface thereby preventing disengagement of said base member from said channels;

(c) a support arm extending from and supported by said base member and including a proximal end portion adjacent to said base member and a distal end portion opposite the proximal end portion; and (d) a lockable element adapted to engage the distal end portion of said support arm and be secured thereto when in a locked state and removable from the distal end portion when in an unlocked state.

6. A security support system according to claim 5 wherein said parallel channels have a T-shaped cross section and wherein at least one of said first and second flanges projects away from said support arm forming an offset end that is sized and configured to be received into a selected channel.

7. A security support system according to claim 5 wherein said parallel channels have a T-shaped cross section and wherein at least one of said first and second flanges forms a reversed flange having a C-shaped cross section that is sized and configured to be received into a selected channel.

8. A security support system adapted to display an item on a slotted support surface having a pair of spaced apart channels formed on a display surface thereof, said security support operative to lockably retain said item against unauthorized removal therefrom, comprising:

(a) a slot support surface having spaced apart parallel channels;

(b) a base member including a central portion having opposite outer first and second edge margins, a first flange disposed on the first edge margin and a second flange disposed on the second edge margin, said first and second flanges projecting oppositely one another and sized and configured to be received in the spaced-apart channels so that said base is secured to the slot surface support and so that said base member cannot be directly disengaged from the display surface, said base member constructed of a first and a second section that are fastened together such that said first and second sections cannot be directly disengaged;

(c) a support arm extending from and supported by said base member and including a proximal end portion adjacent to said base member and a distal end portion opposite the proximal end portion; and (d) a lockable element adapted to engage the distal end portion of said support arm and be secured thereto when in a locked state and removable from the distal end portion when in an unlocked state.

9. A security support system according to claim 8 including a tamper resistant fastener that interconnects said first and second sections to construct said base member after securing said base member to the slot support surface.

10. A security support system according to claim 8 wherein said first and second sections are attached by a permanent means to construct said base member after securing said base member to the slot surface.

11. A method of protecting displayed items from unauthorized personnel removal by lockable retention wherein said display items have a closed portion surrounding an opening, comprising the steps of:

(a) providing a support assembly including a base member and a support arm that extends outwardly therefrom;

(b) mounting said base member to a slot support surface with tamper resistant fasteners such that said unauthorized personnel cannot readily demount said base member from the slot support surface;

(c) placing a display item on said support arm by passing said support arm through the opening in said closed portion; and (d) securing the displayed item by engaging said support arm with a lockable element that is sized and configured such that said lockable element cannot pass through the opening.

12. The method of claim 11 wherein said base member is formed of two sections and wherein the step of mounting said base member to the slot support surface is accomplished by separately mounting each of said two sections and then interconnecting said two sections with said tamper resistant fasteners.

13. The method of claim 11 including the step of providing a plurality of support assemblies and wherein said displayed item is placed on a plurality of support arms.

14. The method of claim 13 including a step of adding a retainer element that is sized to prevent removal of displayed items, said retainer element is to engage at least two of said support arms after placing the displayed item thereon and before securing the displayed item with said lockable element.

15. The method of claim 11 including a step of placing a retainer element that is sized to prevent removal of the displayed item on said support arm after placing the displayed item thereon and before securing the display items with said lockable element.

16. A security support system adapted to lockably retain a displayed item relative to a support surface thereby to protect against unauthorized removal of the displayed item therefrom, comprising:

(a) a base member adapted to be secured to the support surface;

(b) a plurality of support arms each extending from and supported by said base member and including a proximal end portion adjacent to said base member and a distal end portion opposite the proximal end portion, said support arms cooperating together to hold an item for display thereon;

(c) at least one lockable element adapted to engage the distal end portion of a respective support arm and be secured thereto when in a locked state and removable from the distal end portion when in an unlocked state, whereby a displayed item placed on said support arms is protected against unauthorized removal therefrom when said lockable element is in the locked state; and (d) a common retainer element adapted to engage at least two of said support arms, said retainer element being sized and configured to prevent removal of the displayed item when said retainer engages said support arms and is secured by said lockable element in the locked state and removable when said lockable element is in an unlocked state.

17. A security support system adapted to lockably retain a displayed item relative to a support surface thereby to protect against unauthorized removal of the displayed item therefrom, comprising:

(a) a base member adapted to be secured to the support surface;

(b) a plurality of support arms each extending from and supported by said base member and including a proximal end portion adjacent to said base member and a distal end portion opposite the proximal end portion, said support arms cooperating together to hold an item for display thereon; and (c) a plurality of lockable elements each adapted to engage the distal end portion of a respective one of said support arms and be secured thereto when in a locked state and removable therefrom when in an unlocked state.

18. A security support system according to claim 17 including a plurality of retainer elements, each adapted to engage a respective one of said support arms, said retainer elements each being sized and configured to prevent removal of the displayed item when each said retainer element engages its respective said support arm and each said retainer element is secured by a respective said lockable element in a locked state and removable from the distal end portion when in an unlocked state.

19. A security support system adapted to lockably retain a displayed item relative to a support surface thereby to protect against unauthorized removal of the displayed item therefrom, comprising:

(a) a plurality of base members adapted to be secured to the support surface; (b) a plurality of support arms each extending from and supported by a respective individual base member, each having a proximal end portion adjacent to each respective base member and a distal end portion opposite the proximal end portion, said support arms operative to hold an item for display thereon; and (c) a lockable element adapted to engage the distal end portion of a respective said support arm and be secured thereto when in a locked state and removable from the distal end portion when in an unlocked state, whereby a displayed item placed on said support arm is protected against unauthorized removal therefrom when said lockable element is in the locked state.

20. A security support system according to claim 19 including a retainer element adapted to engage said support arms, said retainer element being sized and configured to prevent removal of the displayed item when said retainer engages said support arms and is secured by said lockable element in a locked state, said retainer being removable when said lockable element is in an unlocked state.

21. A security support system according to claim 19 including a plurality of lockable elements each adapted to engage the distal end portion of a respective one of said support arms and be secured thereto when in a locked state and removable from the distal end portion when in an unlocked state.

22. A security support system according to claim 19 including a plurality of retainer elements, each adapted to engage one of said support arms, said retainer elements each being sized and configured to prevent removal of the displayed item when each said retainer element engages each said support arm and each said retainer element is secured by one of a plurality of lockable elements that are adapted to engage the distal end of said support arms and be secured thereto when in a locked state and removable from the distal end portions when in an unlocked state.

23. A security support system adapted to lockably retain a displayed item relative to a support surface thereby to protect against unauthorized removal of the displayed item therefrom, comprising:

(a) a base member adapted to be secured to the support surface;

(b) a support arm extending from and supported by said base member and including a proximal end portion adjacent to said base member and a distal end portion opposite the proximal end portion, said distal end portion having a peripheral groove extending therearound to define a neck supporting a distal head, said distal head having a cross-section that is elongated in one dimension; and (c) a lockable element adapted to engage the distal end portion of said support arm and be secured thereto when in a locked state and removable from the distal end portion when in an unlocked state, said lockable element including an arcuate hasp sized and adapted to be insertable over said head when in the unlocked state and to engage the peripheral groove when in the locked state thereby to prevent removal of said lockable element from said support arm whereby a displayed item placed on said support arm is protected against unauthorized removal therefrom it when said lockable element is in the locked state.

* * * * *